US011408417B1

(12) United States Patent
Stephenson et al.

(10) Patent No.: US 11,408,417 B1
(45) Date of Patent: Aug. 9, 2022

(54) AUTOMATIC SELECTION AND CONTROL OF PUMPS FOR WELL STIMULATION OPERATIONS

(71) Applicant: Halliburton Energy Services, Inc., Houston, TX (US)

(72) Inventors: Stanley Vernon Stephenson, Duncan, OK (US); Timothy Holiman Hunter, Duncan, OK (US); Billy D. Coskrey, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/471,988

(22) Filed: Sep. 10, 2021

(51) Int. Cl.

| | |
|---|---|
| ***F04B 49/00*** | (2006.01) |
| ***F04B 23/06*** | (2006.01) |
| ***E21B 43/26*** | (2006.01) |
| ***F04B 49/02*** | (2006.01) |

(52) U.S. Cl.
CPC ..... *F04B 49/007* (2013.01); *E21B 43/2607* (2020.05); *F04B 23/06* (2013.01); *F04B 49/02* (2013.01); *F04B 2203/0603* (2013.01)

(58) Field of Classification Search
CPC ..... F04B 49/007; F04B 49/02; F04B 23/06; F04B 2203/0603; E21B 43/2607
See application file for complete search history.

(56) References Cited

U.S. PATENT DOCUMENTS

| | | | | |
|---|---|---|---|---|
| 10,584,698 | B2 | 3/2020 | Haddad et al. | |
| 10,655,435 | B2 | 5/2020 | Oehring et al. | |
| 10,815,764 | B1 * | 10/2020 | Yeung | F04B 51/00 |
| 2020/0370988 | A1 | 11/2020 | Rogers et al. | |
| 2021/0040830 | A1 | 2/2021 | Mu et al. | |
| 2021/0372394 | A1 * | 12/2021 | Bagulayan | F04B 1/06 |
| 2021/0388703 | A1 * | 12/2021 | Hunter | E21B 43/26 |

* cited by examiner

*Primary Examiner* — Charles G Freay
(74) *Attorney, Agent, or Firm* — Conley Rose, P.C.; Rodney B. Carroll

(57) ABSTRACT

A system and method for automatic selection and control of pumps for well stimulation operations is disclosed. In certain embodiments, a system may comprise a pumping system comprising one or more pumping units, a fluid manifold providing fluid communication between the one or more pumping units and a wellbore, and a controller for determining a torque capability of the one or more pumping units.

17 Claims, 4 Drawing Sheets

AUTOMATIC SELECTION AND CONTROL OF PUMPS FOR WELL STIMULATION OPERATIONS

TECHNICAL FIELD

The present disclosure relates generally to treatment operations for hydrocarbon wells, and more particularly, to automatic selection and control of pumps for well stimulation operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Subterranean operations involve a number of different steps such as, for example, drilling a wellbore at a desired well site, treating and stimulating the wellbore to optimize production of hydrocarbons, and performing the necessary steps to produce and process the hydrocarbons from the subterranean formation.

Treating and stimulating a wellbore can include, among other things, delivering various fluids (along with additives, proppants, gels, cement, etc.) to the wellbore under pressure and injecting those fluids into the wellbore. One example treatment and stimulation operation is a hydraulic fracturing operation in which the fluids are highly pressurized via pumping systems to create fractures in the subterranean formation. The pumping systems typically include a number of high-pressure, reciprocating pumps driven through conventional transmissions by diesel engines, which are used due to their ability to provide high torque to the pumps.

As an engine ages over time, the horsepower the engine can deliver decreases. Additionally, under in certain conditions, such as high altitudes or high ambient temperatures, engine horsepower capability can degrade. As a result, pumps with degraded engines may lack the required torque to start a pump, especially as pressure rises in the wellbore. Knowing which pumps have degraded engines, and thus, which pumps should be brought online first is typically left up to operator knowledge and judgment.

BRIEF DESCRIPTION OF THE DRAWINGS

For a more complete understanding of the present disclosure and its features and advantages, reference is now made to the following description, taken in conjunction with the accompanying drawings, in which.

Figure 1:
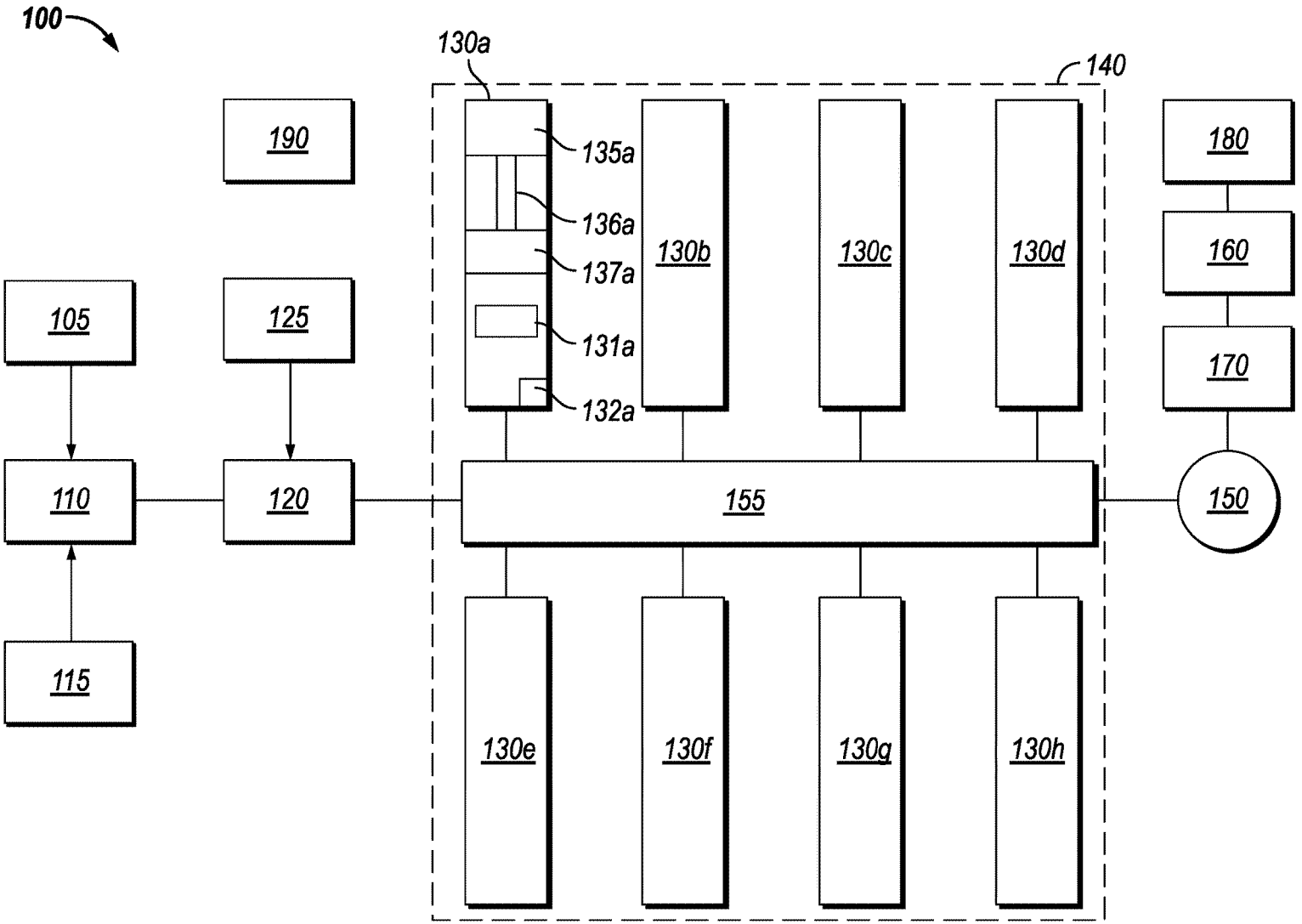
FIG. 1 is a diagram illustrating an example pumping system, according to certain aspects of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The terms "couple" or "couples" as used herein are intended to mean either an indirect or a direct connection. Thus, if a first device couples to a second device, that connection may be through a direct connection, or through an indirect mechanical or electrical connection via other devices and connections. The term "fluidically coupled" or "in fluid communication" as used herein is intended to mean that there is either a direct or an indirect fluid flow path between two components. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection Throughout this disclosure, a reference numeral followed by an alphabetical character refers to a specific instance of an element and the reference numeral alone refers to the element generically or collectively. For example, a widget "1a" refers to an instance of a widget class, which may be referred to collectively as widgets "1" and any one of which may be referred to generically as widget "1". In the figures and the description, like numerals are intended to represent like elements. A numeral followed by the alphabetical characters "N" refers to any number of widgets.

The present disclosure is directed to a method and system for automatic selection and priority control of a pumping system comprising one or more pumps. Certain aspects of the present disclosure use the engine's fueling and the pump as a dynamometer to identify the pumps of a pumping system with the lowest horsepower. Pumps identified with the lowest horsepower can be selected to be brought online first, when the pressure in the wellbore is lower, and thus, the required torque needed to start the pump is higher. By bringing online the weaker pumps first, more pumps may be brought online overall, thus, increasing the overall pumping capacity of the pumping system and ensuring the pumping system is able to provide sufficient horsepower at a given wellsite to deliver the total flowrate designed for a particular stimulation treatment.

FIG. 1 is a diagram illustrating an example system 100 for well treatment operations, according to aspects of the present disclosure. The system 100 may include a hydrator 110 in fluid communication with a blender 120. The blender 120 may in turn be in fluid communication with one or more pumping units 130 through a fluid manifold 155. The fluid manifold 155 may provide fluid communication between the pumping units 130 and a wellbore 150. In certain embodiments, the hydrator 110 may receive water or another fluid from a fluid source 105 (e.g., a ground water source, a pond, one or more frac tanks) and one or more additives (e.g., polyacrylamide, guar gum, or other chemical additives) from an additive source 115. Hydrator 110 may mix the one or more additives into the received water or fluid to produce a treatment fluid with a desired fluid characteristic, and provide the produced treatment fluid to the blender 120. The blender 120 may receive a proppant (e.g., sand, grain, fertilizer, or other granular material) from a proppant source 125 (e.g., a silo, surge hopper, or other storage container for storing proppant). The blender 120 may receive the produced treatment fluid from the hydrator 110 and mix the produced treatment fluid with the proppant to produce a final treatment fluid that is directed to the fluid manifold 155. The one or more pumping units 130 may then pressurize the final treatment fluid to generate pressurized final treatment fluid that is directed into the wellbore 150, where the pressurized final treatment fluid generates fractures within a formation (not shown) in fluid communication with the wellbore 150.

Each of the one or more pumping units 130 may comprise a prime mover 135, transmission 136, and pump 137. For example, as shown in FIG. 1, pumping unit 130*a* may comprise a prime mover 135*a*, a transmission 136*a*, and a pump 137*a*. As used herein, a prime mover may comprise any device that converts energy into mechanical energy to drive a pump. Example movers include, but are not limited to, internal combustion engines, hydrocarbon-driven or steam engines, turbines, electric motors, etc. Prime mover 135 may be coupled to a transmission 136 with one or more gears (not shown) that transmits mechanical energy from the prime mover 135 to the pump 137. Transmission 136 may comprise multiple gear ratios that allows the transmission 136 to vary the speed of the gears. In certain embodiments, one or more pumping units 130 may comprise a hydrostatic drive system. For example, in certain embodiments, transmission 136 may comprise a hydrostatic drive system. In certain embodiments, where transmission 136 is a hydrostatic drive system, job controller 190 may determine an optimal input to output speed ratio of the hydrostatic drive. In certain embodiments, element 136 may be a driveline with a single speed ratio and may further comprise a fixed speed gearbox. In certain embodiments, the prime mover 135 may be directly coupled to the pump 137, and element 136 may not be present. The prime mover 135 may receive energy or fuel in one or more forms from sources at the wellsite or from location remote from the wellsite. The energy or fuel may comprise, for instance, hydrocarbon-based fuel, electrical energy, hydraulic energy, thermal energy, etc. The sources of energy or fuel may comprise, for instance, on-site fuel tanks, mobile fuel tanks delivered to the site, electrical generators onsite or offsite, hydraulic pumping systems, etc. The prime mover 135 may then convert the fuel or energy into mechanical energy that can be used to drive the associated pump 137. For instance, to the extent the pumping units 130 comprise reciprocating pumps, the mechanical energy may comprise torque that drives the pump 137.

In certain embodiments, the prime mover 135*a* may comprise an internal combustion engine such as a diesel or dual fuel (e.g., diesel and natural gas) engine. In other embodiments, the prime mover 135*a* may comprise an electric motor. However, in certain instances, electric motors may have limited horsepower capabilities due to insufficient electrical power from the generator, for example, due to dirty filters, high altitude, or a limit of the number of pumps that can be attached to the single generator. In certain embodiments, where the prime mover 135*a* is an internal combustion engine, the internal combustion engine 135*a* may receive a source of fuel from one or more fuel tanks (not shown) that may be located within the pumping unit 130 and refilled as necessary using a mobile fuel truck driven on site. In other embodiments, where the prime mover 135*a* is an electric motor, the electric motor may be electrically coupled to a source of electricity (not shown), for example, via an electrical connection 312. Example sources of electricity include, but are not limited to, an on-site electrical generator, a public utility grid, one or more power storage elements, solar cells, wind turbines, other power sources, or one or more combinations of any of the previously listed sources.

In certain embodiments, each of the one or more pumping units 130 may comprise a pumping unit control system 131. For example, pumping unit 130*a* may comprise a pumping unit control system 131*a*. In certain embodiments, a pumping unit control system 131 may be referred to as an engine control module (ECM). Pumping unit control system 131 may be operable to track one or more characteristics of the pumping unit 130, for example, via one or more sensors 132. For example, the pumping unit control system 131 may be able to track the amount of fuel being used by the pumping unit 130, the fluid pressure output from pumping unit 130, the fluid flowrate output from pumping unit 130, the temperature of pump 137, transmission 136, and/or prime mover 135, air filter differential pressure of pumping unit 130, and oil pressure of pump 137 and prime mover 135. In certain embodiments, the pumping unit control system 131 may further comprise a display panel (not shown) for displaying any one or more of the tracked measurements to an operator. In certain embodiments, the pumping unit control system 136 may be in communication with the job controller 190 and may transmit any one or more measurements or data to the job controller 190. In certain embodiments, a control network may be used to communicate one or more parameters between one or more pumping units 130 and the controller 190. In certain embodiments, a control network may be a controller area network ("CAN").

The pumping unit control system 131 may further comprise a memory for storing one or more characteristics or properties associated with a pumping unit 130. For example, the pumping unit control system 131 may store data regarding the duration the pumping unit 130 has been in operation, the date the pumping unit 130 was first put into operation, or other parameters needed to monitor and control the pumping system, for example, temperature, pressure, and flowrate parameters can be communicated to the job controller 190. In certain embodiments, the pumping unit control system 131 may store a unique identifier to specifically identify a given pumping unit 130, for example pumping unit 130*a*, 130*b*, 130*c*, 130*d*, 130*e*, 130*f*, 130*g*, or 130*h* as shown in FIG. 1. In certain embodiments, when a pumping unit 130 is installed at a fracturing site 100, data or information regarding the pumping unit 130 may be automatically transmitted from the pumping unit control system 131 to job controller 190.

Job controller 190 may determine one or more characteristics or properties of a given pumping unit 130 based on the data received from an associated pumping unit control system 131. In certain embodiments, job controller 190 may be able to determine a brake horsepower required by a pumping unit 130 and engine 135 based on the hydraulic horsepower from the pump 137 and the mechanical efficiency of the transmission 136 and pump 137. For example, the brake horsepower may be determined by using the following equation:

Brake horsepower=hydraulic horsepower/transmission efficiency/pump efficiency where:

Hydraulic horsepower=pump pressure×pump flowrate (gpm)/1714

In one embodiment, real time measurement of engine 135 performance can be based on a percentage load from the engine 135 and the hydraulic horsepower (hhp) being delivered by the pump 137. The percentage load may be obtained from the pumping unit control system 131 or ECM. As the engine's performance degrades, more engine percentage load (fuel rate) per hhp measures the degradation in a quantifiable manner which enables prioritization of the one or more pumping units 130. Job controller 190 may store degradation data related to each pumping unit 130 for use in future pumping operations. In certain embodiments, job controller 190 may assign a quantitative score to each pumping unit 130 or may rank the pumping units 130 individually or in tiered fashion based on the ratio or percentage engine load to hhp load from the pump. The determined quantitative score and/or ranking may be determined based on available parameters measured from one or more sensors, e.g., sensor 132, on the prime mover 135, transmission 136, and/or pump 137. As explained in more detail with respect to FIGS. 2A-2B, job controller 190 may use this data to determine which pumping units 130 to start-up or bring online earlier or later in a pumping operation, based on the relative horsepower of a given pumping unit 130 as compared to other pumping units 130. For example, job controller 190 may determine a relative torque capability and/or speed capability of the one or more pumping units 130 based on the determined horsepower.

The prioritization of the one or more pumping units 130 may be used to determine an order or sequence of bringing the one or more pumping units 130 online. For example, in certain embodiments, the pumping unit 130 with the most or highest degradation may be brought online first. Then the pumping unit 130 with the next highest degradation may be brought online and the process may be repeated until the pumping unit 130 with the lowest degradation may be brought online last. The job controller 190 may determine and maintain a priority order of pumping units 130. In certain embodiments, the engine load capability described above may be augmented by measurements or knowledge of air filter differential pressure and/or fuel filter differential pressure. Increases in either the air filter differential pressure or the fuel filter differential pressure may further reduce the engine capabilities. For example, as the ratio of a differential pressure for a used filter to the differential pressure of a new filter rises, the engine degradation increases. A job controller 190 may determine and maintain maps or tables of the ratio of degradation and may be used to determine an added percent degradation.

In certain embodiments, the source of electricity may be a generator 160 located at the well site. The generator 160 may comprise, for instance, a gas-turbine generator or an internal combustion engine that produces electricity to be consumed or stored on site. In the embodiment shown, the generator 160 may receive and utilize natural gas from the wellbore 150 or from another wellbore in the field (i.e., "wellhead gas") to produce the electricity. As depicted, the system 100 may include gas conditioning systems 170 that may receive the gas from the wellbore 150 or another source and condition the gas for use in the generator 160. Example gas conditioning systems include, but are not limited to, gas separators, gas dehydrators, gas filters, etc. In other embodiments, conditioned natural gas may be transported to the well site for use by the generator.

The system 100 may further include one or more energy storage devices 180 that may receive energy generated by the generator 160 or other on-site energy sources and store in one or more forms for later use. For instance, the storage devices 180 may store the electrical energy from the generator 160 as electrical, chemical, or mechanical energy, or in any other suitable form. Example storage devices 180 include, but are not limited to, capacitor banks, batteries, flywheels, pressure tanks, etc. In certain embodiments, the energy storage devices 180 and generator 160 may be incorporated into a power grid located on site through which any of the hydrator 110, blender 120, pumping units 130, and gas conditioning systems 170 may receive power.

In certain embodiments, the pumping units 130 may be electrically coupled to a controller 190 that directs the operation of the prime movers 135 of the pumping units 130. The controller 190 may comprise, for instance, an information handling system 400 as described in FIG. 4, that sends one or more control signals to the pumping units 130 to control the speed/torque output of the prime movers 135. The control signals may take whatever form is necessary to communicate with the associated mover. For instance, a control signal to an electric motor may comprise an electrical control signal to a variable frequency drive coupled to the electric motor, which may receive the control signal and alter the operation of the electric motor based on the control signal. In certain embodiments, the controller 190 may also be electrically coupled to other elements of the system, including the hydrator 110, blender 120, pump units 130, generator 160, and gas conditioning systems 170 in order to monitor and/or control the operation of the entire system 100. In other embodiments, some or all of the functionality associated with the controller 190 may be located on the individual elements of the system, e.g., each of the pump systems 130 may have individual controllers that direct the operation of the associated prime movers 135.

It should be appreciated that only one example configuration is illustrated in FIG. 1 and that other embodiments and configurations are possible, depending on the needs of a particular wellsite or fracturing job. For example, while eight pumping units 130 are shown in FIG. 1, in certain embodiments, other quantities of pumping units 130 may be required or desire, for example, two, four, ten, twenty, or fifty pumping units 130. The configurations of the individual pumping units 130 and of the pumping system 140 generally may depend, for instance, on the particular needs of a fracturing job or characteristics of the formation.

Figure 2B:
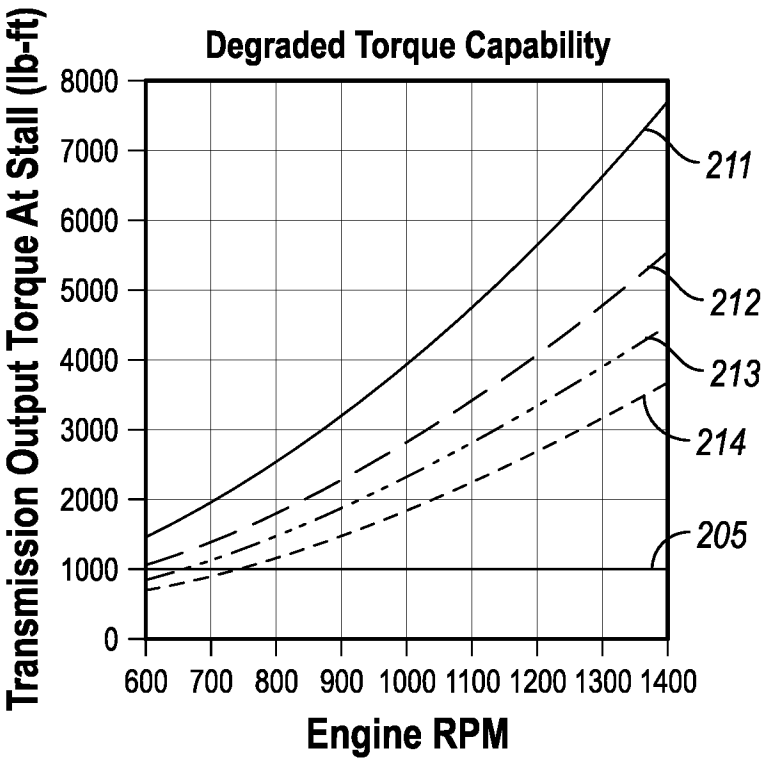
FIGS. 2A-2B depict an example illustrating pump performance over time for treatment operations, according to aspects of the present disclosure.
Figure 2A:
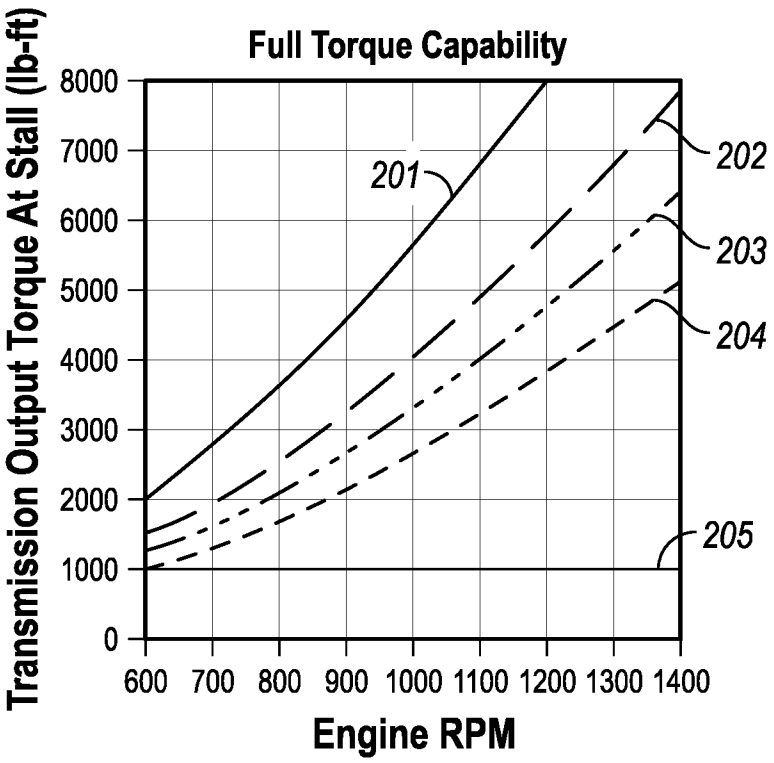

FIGS. 2A and 2B illustrate an example of operating characteristics of a pumping unit 130 as pumping performance degrades over time. FIG. 2A represents a pumping unit 130 at full torque capability and FIG. 2B represents a pumping unit 130 at degraded torque capability. In certain embodiments, the pumping unit 130 depicted by FIGS. 2A and 2B may be a 4 inch quintuplex reciprocating pump. However, as would be understood by one of ordinary skill in the art, other types of pumps may have similar operating characteristics, for example, 4.5-inch, 5-inch, or 6-inch pumps, or tri-plex pump of various plunger sizes. FIGS. 2A and 2B depict graphs comparing transmission output torque at stall in ft-lbs to engine RPM. As used herein, "at stall" may refer to a condition where the output torque from a torque converter at a specific engine rpm is lower than the torque required by the pump due to the pressure in the fluid line to the wellhead. In an "at stall" condition, the output torque from a torque converter is lower than the torque required at a given pressure in the wellhead, and therefore, the pump cannot start.

The horizontal line 205 may represent the required torque for a pumping unit 130 to come online. As an example, in certain embodiments, the required torque for a pumping unit 130 to come online is 10,500 psi or 1050 ft-lbs. As discussed above, the required torque needed for a pumping unit 130 to come online may correspond to the wellhead pressure, which consists of the friction pressure in the surface lines and wellbore, hydrostatic pressure of the fluid being pumped, friction pressure loss across perforations into the wellbore, friction pressure in the fractures due to flowrate of fluid, and the pressure required to initiate or extend the fracture network in the reservoir. The required torque of a given pumping unit 130 may be also affected by the number of other pumping units 130 already online or the flowrate and pressure of other pumping units 130. Wellhead pressure may be built up over time as higher flowrates are pumped into the wellbore. As discussed above, each pumping unit 130 may comprise a transmission 136 that has multiple gear ratios, also referred to as "gears". For example, in certain embodiments, a pumping unit 130 may have six to eight gears. As would be understood by one of ordinary skill in the art, a given pumping unit 130 may have a fewer or greater number of gears in keeping with aspects of the present disclosure. Lines 201, 202, 203, and 204 represent an exemplary set of gears of a pumping unit 130. For example, in certain embodiments, line 201 represents a first gear, line 202 represents a second gear, line 203 represents a third gear, and line 204 represents a fourth gear.

In certain embodiments, 600 RPM may represent the idle engine speed of the pumping unit 130, for example, when a pumping unit 130 is offline and not pumping fluid. As shown in FIG. 2A, at 600 RPM, lines 201, 202, and 203 show a transmission output torque required to overcome the wellhead pressure represented by line 205. Thus, at full torque capability, a pumping unit 130 may be able to start in first, second, or third gears. However, line 204 may be below the required transmission output torque at 600 RPM and thus, pumping unit 130 may not be able to start in fourth gear. As shown in FIG. 2A, once the pumping unit 130 starts and begins to increase in RPM, the transmission output torque may increase in a parabolic or non-linear fashion. In certain embodiments, the average operating speed may be 1400 RPM.

By way of example, FIG. 2B shows the same pumping 130 as FIG. 2A but with degraded torque capability. Similar to FIG. 2A, lines 211, 212, 213, and 214 represent a first gear, second gear, third gear, and fourth gear of pumping unit 130, but under degraded conditions. As discussed above, one or more factors can result in degraded torque capability, for example, the age (wear) of the pumping unit 130, the altitude or temperature of the wellsite environment, or other maintenance issues that may arise with the pumping unit 130. Under degraded conditions, only line 211 representing a first gear of pumping unit 130 may have the required torque output to overcome the wellhead pressure. Lines 212, 213, and 214 show an output torque below the threshold in line 205 needed for pumping unit 130 to come online, and thus, pumping unit 130 may not be able to start in second, third, or fourth gears. In certain instances, degradation may be severe such that a pumping unit 130 cannot be started in any gear (not shown).

A job controller 190 may determine when to activate a pumping unit 130 based the operating characteristics as described above with respect to FIGS. 2A and 2B. A controller 190 may receive information regarding the torque capability and/or speed capability of each pumping unit 130, for example pumping units 130*b* and 130*c*, from the pumping unit control system 131 of each respective pumping unit 130. At the beginning of a fracturing job, the wellhead pressure may be lower such that any one or more of pumping units 130 may be brought online. However, as additional pumping units 130 are brought online, the wellhead pressure may begin to rise. At a certain wellhead pressure, for example, a wellhead pressure corresponding to line 205 of FIGS. 2A and 2B, certain pumping units 130 may not have the required torque capability to come online.

For example, referring back to FIG. 1, in certain embodiments, pumping unit 130*b* may be a pumping unit operating at full torque capability and pumping unit 130*c* may be a pumping unit operating at degrade torque capability. Job controller 190 may receive information regarding the wellhead pressure from one or more sensors positioned at the wellhead (not shown). Thus, as the wellhead pressure rises, job controller 190 may send a signal to activate pumping unit 130*c* first, while pumping unit 130*c* still has the output torque required to start. Job controller 190 may then send a signal to activate pumping unit 130*b* second, because pumping unit 130*b* has the necessary output torque required at the higher pressures. In certain embodiments, job controller 190 may prioritize all of the pumping units 130 at a wellsite, for example, pumping units 130*a*, 130*b*, 130*c*, 130*d*, 130*e*, 130*f*, 130*g*, and 130*h* based on each pumping unit's torque capability. For example, controller 190 may assign each pumping unit 130 a numerical score, e.g., on a scale of 1-100.

In certain embodiments, a job controller 190 may be operable to automatically bring a pumping unit 130 online when the wellhead pressure drops below a threshold that a weaker pumping unit can be brought online. For example, in certain embodiments, pumping unit 130*d* may have degraded torque capability, and thus, may not be able to be brought online after pumping units 130*b* and 130*c* have begun pumping. However, in certain circumstances, e.g., during a diversion stage, the wellhead pressure may drop and become low enough to bring pumping unit 130*d* online. Job controller 190 may sense the lower wellhead pressure and automatically send a signal to pumping unit 130*d* to initiate pumping. Thus, pumping unit 130*d* will be online and available to ramp up as increased fluid pressure is needed during a fracturing job. In certain embodiments, job controller 190 may keep weaker pumping units 130, for example pumping units 130*c* and 130*d*, online even when fluid is not necessarily needed from those pumping units 130, in order to keep them operable for later operations.

Job controller 190 may also be used to determine which pumping units 130 should be used for a particular fracturing job. Job controller 190 may further store information regarding torque capabilities and required pressures for each pumping unit 130. For example, in certain embodiments, pumping units 130 with full torque capability may be needed at a different wellsite. An operator could access job controller 190, for example, through a display panel or through a remote communications system (not shown) to identify which pumping units 130 would be best suited for the new fracturing job. Job controller 190 may transmit data including torque capabilities and required pressures for the pump to come online to the pumping unit control system 131 associated with each pumping unit 130, such that if a pumping unit 130 is moved to a different wellsite, the information is retained with the pumping unit 130.

In certain embodiments, the job controller 190 may augment torque capability determinations based on one or more factors, for example, the air filter differential pressure or the fuel filter differential pressure of an engine 135. For example, in certain embodiments, controller 190 may determine that the air filter or fuel filter (not shown) of engine 135 is clogged, and thus, a pumping unit 130 is not receiving a sufficient amount of air. Thus, in these circumstances, job controller 190 may determine that the torque capability of a pumping unit is lower than the degradation calculated between percentage engine load and actual pump load. Job controller 190 may similarly monitor other factors that may impact engine performance, e.g., exhaust temperature, transmission slippage, vibration, fluid level, etc., and appropriately augment the calculated torque capability of the pumping unit 130 based on the measured parameter.

Figure 3:
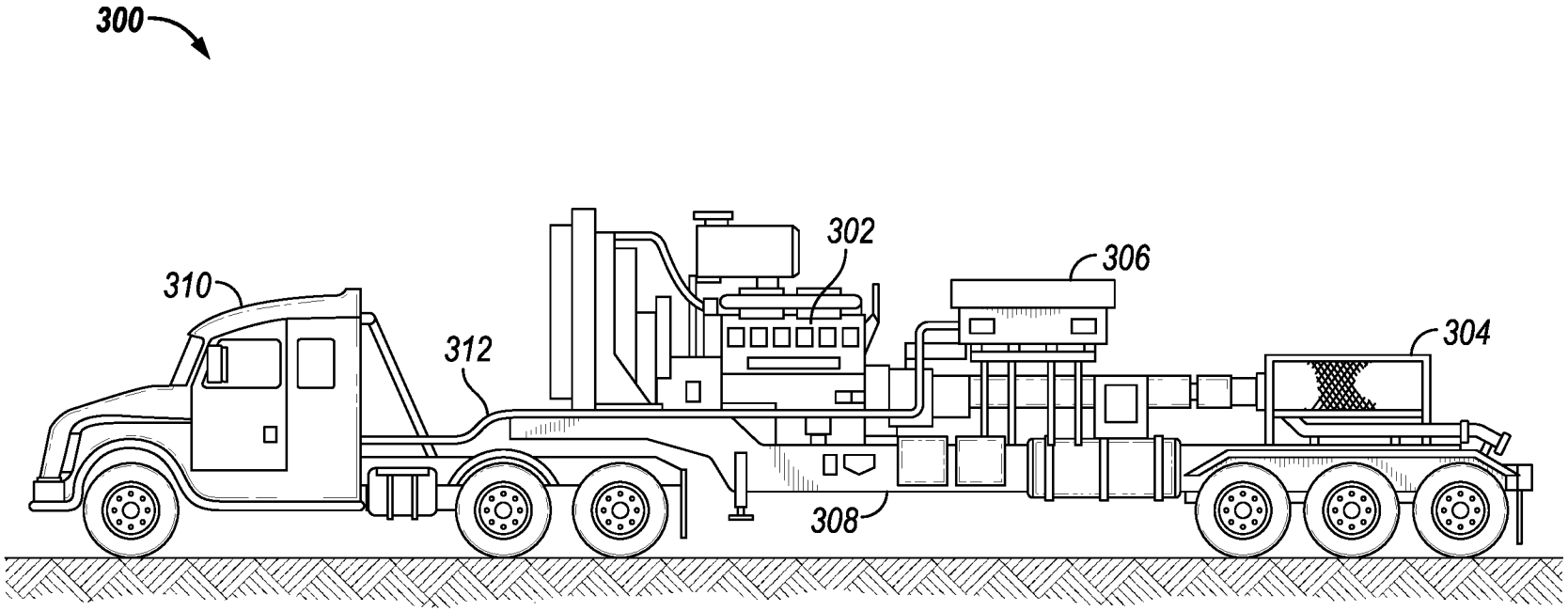
FIG. 3 is a diagram illustrating an example pumping system, according to aspects of the present disclosure.

FIG. 3 illustrates an example pumping system 300, according to aspects of the present disclosure. The pumping system 300 may be used, for instance, as one or more of the pumping systems described above with reference to FIG. 1. As depicted, the system 300 comprises a prime mover 302 in the form of an engine coupled to a reciprocating pump 304 through a transmission system 306. The prime mover 302, pump 304, and transmission system 306 are mounted on a trailer 308 coupled to a truck 310. The truck 310 may comprise, for instance, a conventional engine that provides locomotion to the truck 310 and trailer 308.

In use, the truck 310 and trailer 308 with the pumping equipment mounted thereon may be driven to a well site at which a fracturing or other treatment operation will take place. In certain embodiments, the truck 310 and trailer 308 may be one of many similar trucks and trailers that are driven to the well site. Once at the site the pump 304 may be fluidically coupled to a wellbore (not shown), such as through a fluid manifold, to provide treatment fluid to the wellbore. The pump 304 may further be fluidically coupled to a source of treatment fluids to be pumped into the wellbore. When connected, the engine 302 may be started to provide a primary source of torque to the pump 304 through the pump transmission system 306. In certain embodiments, the prime mover 302 for the pump 304 may receive electricity from other energy sources on the site, for example, a dedicated electrical generator on site or from an electrical power grid.

Figure 4:
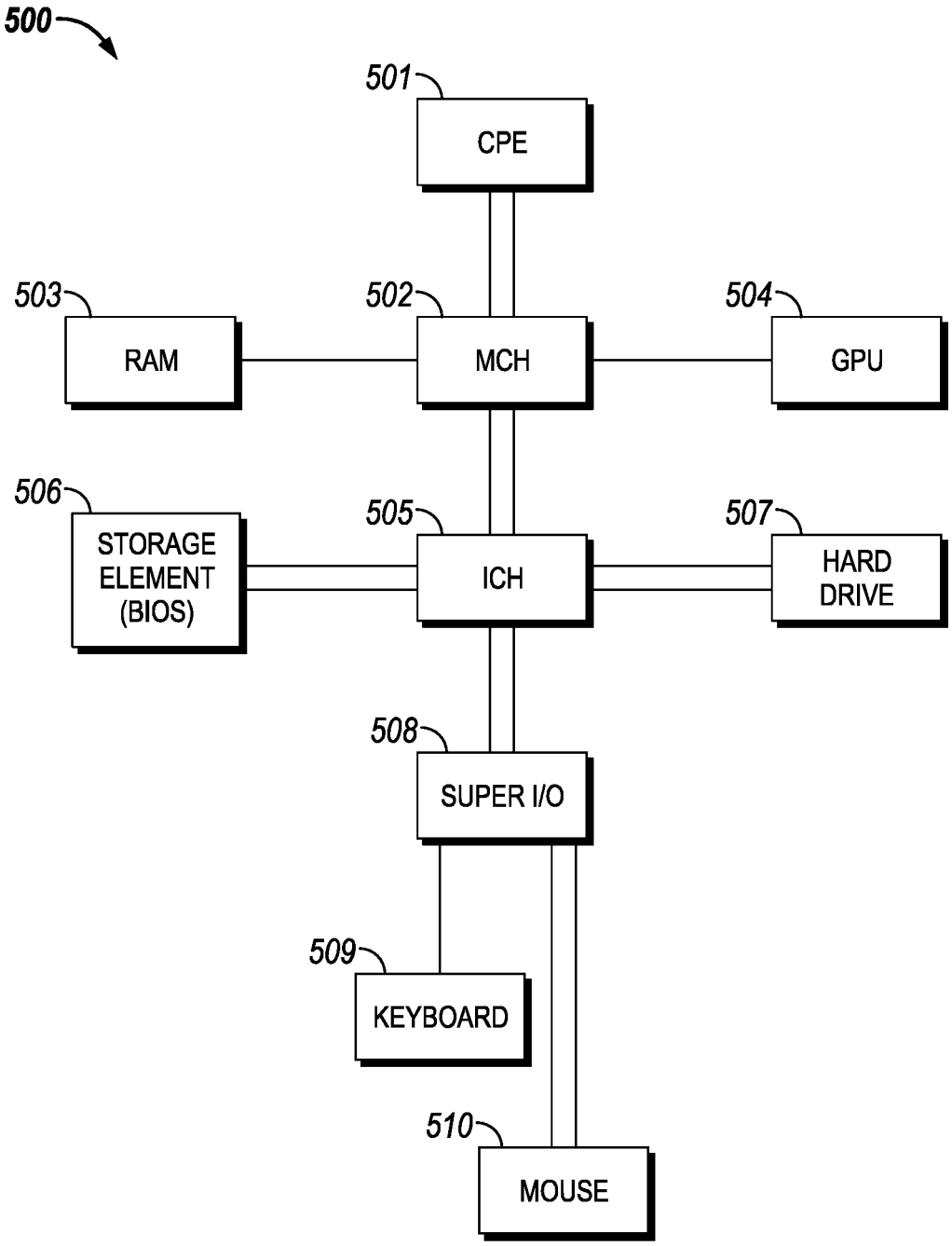
FIG. 4 is a block diagram illustrating an example information handling system, according to aspects of the present disclosure.

FIG. 4 is a diagram illustrating an example information handling system, according to aspects of the present disclosure. In certain embodiments, controller 190 may take a form similar to the information handling system 400. A processor or central processing unit (CPU) 501 of the information handling system 500 is communicatively coupled to a memory controller hub (MCH) or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 503 or hard drive 507. Program instructions or other data may constitute portions of a software or application for carrying out one or more methods described herein. Memory 503 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or application may be retrieved and stored in memory 503 for execution by processor 501.

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in one or more embodiments, functionality associated with components of information handling system 500 may be implemented in special purpose circuits or components. In one or more embodiments, functionality associated with components of information handling system 500 may be implemented in configurable general purpose circuit or components. For example, components of information handling system 500 may be implemented by configured computer program instructions.

Memory controller hub 502 may include a memory controller for directing information to or from various system memory components within the information handling system 500, such as memory 503, storage element 506, and hard drive 507. The memory controller hub 502 may be coupled to memory 503 and a graphics processing unit 504. Memory controller hub 502 may also be coupled to an I/O controller hub (ICH) or south bridge 505. I/O controller hub 505 is coupled to storage elements of the information handling system 500, including a storage element 506, which may comprise a flash ROM that includes a basic input/output system (BIOS) of the computer system. I/O controller hub 505 is also coupled to the hard drive 507 of the information handling system 500. I/O controller hub 505 may also be coupled to a Super I/O chip 508, which is itself coupled to several of the I/O ports of the computer system, including keyboard 509 and mouse 510.

A system and method for automatic selection and control of pumps for well stimulation operations is disclosed. In certain embodiments, a system may comprise a pumping system comprising one or more pumping units, a fluid manifold providing fluid communication between the one or more pumping units and a wellbore, and a controller for determining a torque capability of the one or more pumping units. In certain embodiments, each of the one or more pumping units may comprise a prime mover and a pump. In certain embodiments, the pumping system may further comprise a transmission, driveline, or hydrostatic drive system. In certain embodiments, the prime mover may be an electric motor, diesel engine, dual fuel engine, turbine engine, or spark ignited engine to provide power to the pumping system. In certain embodiments, the controller may determine the torque capability of the one or more pumping units based, at least in part, on the hydraulic horsepower of the one or more pumping units. In certain embodiments, the controller may assign a quantitative score or ranking to each of the one or more pumping units. In certain embodiments, the controller may prioritize the one or more pumping units for utilization or start-up based on the determined torque capability of the one or more pumping units. In certain embodiments, the one or more pumping units may each comprise a pumping unit control system for storing any one or more characteristics or measurements of the one or more pumping units. In certain embodiments, the system may further comprise a blender to provide a treatment fluid to the pumping system.

In certain embodiments, a method may comprise fluidically coupling a plurality of pumping units to one or more wellbores, determining a torque capability of each of the plurality of pumping units, selecting a first pumping unit based on a first torque capability to begin operation, pumping treatment fluid from the first pumping unit to the one or more wellbores, selecting a second pumping unit based on a second torque capability to begin operation, and pumping treatment fluid from the second pumping unit to the one or more wellbores. In certain embodiments, selecting the first and second pumping units may comprise determining a brake horsepower and percent engine load of the first and second pumping units. In certain embodiments, the first torque capability may represent a lowest torque capability, and the second torque capability may represent a higher torque capability than the first torque capability. In certain embodiments, the method further comprises selecting a third pumping unit with a third torque capability to begin operation, and pumping treatment fluid from the third pumping unit to the one or more wellbores.

In certain embodiments, a system may comprise a plurality of pumping units fluidically coupled to one or more wellbores, wherein each pumping unit comprises, a pump, a prime mover, and a transmission or driveline. In certain embodiments, the system may further comprise a controller communicatively coupled to the plurality of pumping units, wherein the controller determines a torque capability of each of the plurality of pumping units. In certain embodiments, each pumping unit may further comprise a pumping unit control system for storing one or more characteristics of the pumping unit. In certain embodiments, the controller may send a characteristic or measurement of a pumping unit to the pumping unit control system of the pumping unit. In certain embodiments, the transmission may further comprise one or more gears. In certain embodiments, the controller may further determine one or more operating gears of at least one of the plurality of pumping units, based, at least in part, on a wellhead pressure of at least one of the one or more wellbores. In certain embodiments, the controller may further determine a utilization sequence for start-up of the plurality of pumping units, based, at least in part, on the determined torque capability of each of the plurality of pumping units. In certain embodiments, the controller may augment a determined torque capability of at least one of the plurality of pumping units based on an air filter or fuel filter differential pressure.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

What is claimed is:

1. A system, comprising:

a pumping system comprising one or more pumping units, wherein each of the one or more pumping units comprise a pumping unit control system;

a fluid manifold providing fluid communication between the one or more pumping units and a wellbore; and a controller communicatively coupled to the pumping unit control system of each of the one or more pumping units, wherein the controller is configured to determine a relative current torque capability of each of the one or more pumping units, and wherein the controller is configured to assign a torque capability ranking to each of the one or more pumping units based on the relative current torque capability of each of the one or more pumping units.

2. The system of claim 1, wherein:

the pumping system further comprises any one or more of a transmission, driveline, or hydrostatic drive system; and each of the one or more pumping units comprise a prime mover and a pump.

3. The system of claim 2, wherein the prime mover is an electric motor, diesel engine, dual fuel engine, turbine engine, or spark ignited engine configured to provide power to the pumping system.

4. The system of claim 2, wherein the prime mover is an internal combustion engine.

5. The system of claim 1, wherein:

the controller is configured to determine the hydraulic horsepower of each of the one or more pumping units; and the controller is configured to determine the relative current torque capability of each of the one or more pumping units based, at least in part, on the hydraulic horsepower of each of the one or more pumping units.

6. The system of claim 1, wherein the controller is configured to determine a utilization sequence for the one or more pumping units based on the torque capability ranking of each of the one or more pumping units and a wellhead pressure of the wellbore.

7. The system of claim 6, wherein the controller is further configured to start the one or more pumping units based on the utilization sequence for the one or more pumping units.

8. The system of claim 1, wherein the pumping unit control system is configured to track and store one or more characteristics or measurements of each of the one or more pumping units, and wherein the pumping unit control system is configured to communicate the one or more characteristics or measurements of each of the one or more pumping units to the controller.

9. The system of claim 1, wherein the controller is further configured to determine a relative speed capability of the one or more pumping units.

10. A system comprising:

a plurality of pumping units fluidically coupled to one or more wellbores, wherein each pumping unit of the plurality of pumping units comprises:

a pump;

a prime mover;

one or more of a transmission, driveline, or hydrostatic drive system; and a pumping unit control system; and a controller communicatively coupled to the pumping unit control system of each of the plurality of pumping units, wherein the controller is configured to determine a relative current torque capability of each of the plurality of pumping units, wherein the controller is configured to assign a torque capability ranking to each of the plurality of pumping units based on the relative current torque capability of each of the plurality of pumping units.

11. The system of claim 10, wherein the pumping unit control system of each of the plurality of pumping units is configured to track and store one or more characteristics or measurements of one of the plurality of pumping units.

12. The system of claim 11, wherein the pumping unit control system of each of the plurality of pumping units is configured to communicate the one or more characteristics or measurements of one of the plurality of pumping units to the controller.

13. The system of claim 10, wherein the transmission of each of the pumping units of the plurality of pumping units further comprises one or more gears.

14. The system of claim 13, wherein the controller is further configured to determine one or more operating gears of at least one of the plurality of pumping units based, on a wellhead pressure of at least one of the one or more wellbores.

15. The system of claim 10, wherein the controller is further configured to determine a utilization sequence for the plurality of pumping units based on the torque capability ranking of each of the plurality of pumping units and a wellhead pressure of at least one of the one or more wellbores.

16. The system of claim 15, wherein the controller is further configured to start the plurality of pumping units based on the utilization sequence for the plurality of pumping units.

17. The system of claim 10, wherein the controller is further configured to augment the relative current torque capability of at least one of the plurality of pumping units based on an air filter differential pressure or a fuel filter differential pressure.

* * * * *